US011840108B2

(12) United States Patent
Motohashi

(10) Patent No.: US 11,840,108 B2
(45) **Date of Patent: *Dec. 12, 2023**

(54) THERMAL TRANSFER RIBBON

(71) Applicant: TOPPAN PRINTING CO., LTD., Tokyo (JP)

(72) Inventor: Akira Motohashi, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 350 days.

This patent is subject to a terminal disclaimer.

(21) Appl. No.: 17/135,518

(22) Filed: Dec. 28, 2020

(65) Prior Publication Data

US 2021/0114394 A1 Apr. 22, 2021

Related U.S. Application Data

(63) Continuation of application No. PCT/JP2019/025210, filed on Jun. 25, 2019.

(30) Foreign Application Priority Data

Jun. 29, 2018 (JP) ..... 2018-124785

(51) Int. Cl.
*B41M 5/44* (2006.01)
*B41M 5/385* (2006.01)
*B41M 5/41* (2006.01)

(52) U.S. Cl.
CPC ..... *B41M 5/44* (2013.01); *B41M 5/385* (2013.01); *B41M 5/41* (2013.01)

(58) Field of Classification Search
CPC ..... B41M 5/385; B41M 5/44; B41M 5/41
USPC ..... 428/32.69
See application file for complete search history.

(56) References Cited

U.S. PATENT DOCUMENTS

2018/0319191 A1 11/2018 Hayashi et al.
2021/0114394 A1* 4/2021 Motohashi ..... B41M 5/38264

FOREIGN PATENT DOCUMENTS

| | | | |
|---|---|---|---|
| CN | 108025576 | A | 5/2018 |
| JP | H04-35988 | A | 2/1992 |
| JP | H08-276672 | A | 10/1996 |
| JP | 2005-212302 | A | 8/2005 |
| JP | 2012035448 | A * | 2/2012 |
| JP | 5699384 | B1 | 4/2015 |

(Continued)

OTHER PUBLICATIONS

Thermal Transfer Sheet With Protective Layer. Machine translation of JP2015085554A. (Year: 2015).*

(Continued)

*Primary Examiner* — Betelhem Shewareged
(74) *Attorney, Agent, or Firm* — Foley & Lardner LLP

(57) ABSTRACT

A thermal transfer ribbon comprising a dye layer and a transferable protective layer repeatedly formed on one surface of a substrate, the transferable protective layer having a first layer formed on the substrate, and a second layer formed on the first layer. The first layer comprises an acrylic resin (X) containing methyl methacrylate, an acrylic resin (Y) containing a styrene resin, and a polyester resin (Z). X has a weight average molecular weight of 120000 or more, the mass ratio of X and Y is within the range of 1:9 to 9:1, and the mass of Z is 1% or more and 3% or less of the total mass of X and Y.

2 Claims, 1 Drawing Sheet

(56) References Cited

FOREIGN PATENT DOCUMENTS

| | | | | |
|---|---|---|---|---|
| JP | 2015-085554 | A | | 5/2015 |
| JP | 2015085554 | A | * | 5/2015 |

OTHER PUBLICATIONS

Protective Layer Thermal Transfer Sheet. Machine translation of JP2012035448A. (Year: 2012).*

International Searching Authority, "International Search Report," issued in connection with International Patent Application No. PCT/JP2019/025210, dated Aug. 6, 2019.

International Searching Authority, "Written Opinion," issued in connection with International Patent Application No. PCT/JP2019/025210, dated Aug. 6, 2019.

Office Action dated Nov. 23, 2021 issued in a corresponding Chinese Patent Application No. 201980042511.0, (10 pages).

* cited by examiner

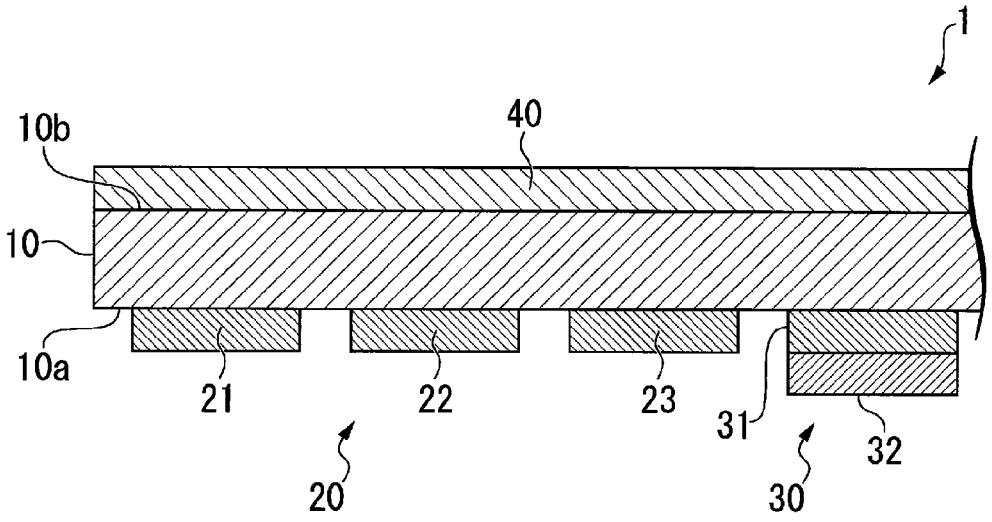
1
40
10b
10
10a
21
22
23
31
32
20
30

THERMAL TRANSFER RIBBON

CROSS-REFERENCE TO RELATED PATENT APPLICATIONS

This application is a continuation application filed under 35 U.S.C. § 111(a) claiming the benefit under 35 U.S.C. §§ 120 and 365(c) of International Patent Application No. PCT/JP2019/025210, filed on Jun. 25, 2019, which is based upon and claims the benefit of priority to Japanese Patent Application No. 2018-124785, filed on Jun. 29, 2018, the disclosures of which are all incorporated herein by reference in their entireties.

TECHNICAL FIELD

The present invention relates to a thermal transfer ribbon.

BACKGROUND ART

Thermal transfer ribbons are ink ribbons used in thermal transfer printers, and are also called thermal ribbons. A general thermal transfer ribbon has a structure that includes a substrate having one surface provided with a thermal transfer ink layer and the other surface provided with a heat-resistant lubricating layer (back coat layer). The ink of the thermal transfer ink layer is transferred to a thermal transfer image-receiving sheet by sublimation (sublimation transfer method) or by melting (melt transfer method) of the ink by application of heat from the thermal head of a printer.

The sublimation transfer method enables easy full-color formation of various images in combination with a sophisticated printer and thus has been used in a wide range of fields, such as real-time prints of digital cameras, cards such as identification cards, and output materials for amusement. Along with the expansion of the usage range, there is an increasing demand for improving the durability of print objects obtained by the sublimation transfer method.

If hand sebum or a plasticizer adheres to the surface of a thermal transfer image formed by a thermal transfer ink made of a sublimable dye, discoloration and image bleeding are likely to occur. In order to suppress these, a technique for improving the durability of print objects has become widespread, in which a protective layer is thermally transferred so as to cover the thermal transfer image recorded by the thermal transfer ink layer.

When a protective layer is provided on a transfer target by thermal transfer, a resin to become the protective layer is melted or softened by the heat of the thermal head, and the protective layer is formed so as to cover the thermal transfer image.

PTL 1 and PTL 2 indicate that a release layer or a peeling layer is provided on a substrate sheet of a thermal transfer ribbon, and a resin layer serving as a protective layer is provided thereon.

In the configurations described in PTL 1 and PTL 2, it is difficult to achieve both durability and transferability in the resin that forms the protective layer. As a result, for example, when the protective layer is excessively tough and has poor foil cutability, or when the substrate and the resin layer are difficult to peel apart, burrs and chips may occur in the formed protective layer. The term "burrs" refers to a phenomenon in which the formed protective layer does not have a smooth shape along the peripheral edge of the thermal transfer image and causes irregular protrusions. The term "chips" refers to a phenomenon in which the formed protective layer does not completely cover the thermal transfer image, and a part of the thermal transfer image is exposed.

Several techniques have been proposed as measures against burr and chips.

PTL 3 indicates that a thermal transferable overcoat layer is formed using an acrylic-silica hybrid resin that is not-tacky at room temperature, and after the thermal transferable overcoat layer is transferred to a transfer target, the transfer area is cured by irradiation with ionizing radiation.

PTL 4 describes a protective layer utilizing the reactivity of epoxy.

CITATION LIST

Patent Literature

PTL 1: JP H04-35988 A; PTL 2: JP H08-276672 A; PTL 3: JP 2005-212302 A; PTL 4: JP 5699384 B.

SUMMARY OF THE INVENTION

Technical Problem

The method of PTL 3 requires the incorporation of a device for irradiating the printer with ionizing radiation, which poses problems from the viewpoint of printer size reduction and cost reduction.

The protective layer material described in PTL 4 has a pot life because of crosslinking due to the reaction between an epoxy group and an amino group. If the crosslinking reaction proceeds before coating, the ink may be gelled and impair the appearance. In order to prevent this problem, it is necessary to form a coating before the crosslinking reaction proceeds too much, which imposes restrictions on the production conditions.

In view of the above circumstances, an object of the present invention is to provide a thermal transfer ribbon that can suitably protect a thermal transfer image with a protective layer while suppressing burrs and chips.

Solution to Problem

The present invention is a thermal transfer ribbon comprising a dye layer and a transferable protective layer repeatedly formed on one surface of a substrate.

The transferable protective layer has a first layer formed on the substrate, and a second layer formed on the first layer. The first layer comprises an acrylic resin (X) containing methyl methacrylate, an acrylic resin (Y) containing a styrene resin, and a polyester resin (Z).

The weight average molecular weight of X is 120000 or more. The mass ratio of X to Y is in the range of 1:9 to 9:1. The mass of Z is in the range of 1% or more and 3% or less of the total mass of X and Y.

Advantageous Effects of the Invention

The thermal transfer ribbon of the present invention can suitably protect a thermal transfer image with a protective layer while suppressing burrs and chips.

BRIEF DESCRIPTION OF THE DRAWING

The FIGURE is a schematic cross-sectional view of a thermal transfer ribbon related to an embodiment of the invention.

DETAILED DESCRIPTION

Embodiments of the present invention of will be described below with reference to the drawings. In the following description of the drawings to be referred, components or functions identical with or similar to each other are given the same or similar reference signs, unless there is a reason not to. It should be noted that the drawings are only schematically illustrated, and thus the relationship between thickness and two-dimensional size of the components, and the thickness ratio between the layers, are not to scale. Therefore, specific thicknesses and dimensions should be understood in view of the following description. As a matter of course, dimensional relationships or ratios may be different between the drawings.

Further, the embodiments described below are merely examples of configurations for embodying the technical idea of the present invention. The technical idea of the present invention does not limit the materials, shapes, structures, arrangements, and the like of the components to those described below. The technical idea of the present invention can be modified variously within the technical scope defined by the claims. The present invention is not limited to the following embodiments within the scope not departing from the spirit of the present invention.

In any group of successive numerical value ranges described in the present specification, the upper limit value or lower limit value of one numerical value range may be replaced with the upper limit value or lower limit value of another numerical value range. In the numerical value ranges described in the present specification, the upper limit values or lower limit values of the numerical value ranges may be replaced with values shown in examples. The configuration according to a certain embodiment may be applied to other embodiments.

With reference to the FIGURE, an embodiment of the present invention will be described.

The FIGURE is a schematic cross-sectional view of a thermal transfer ribbon 1 of the present embodiment. As shown in the FIGURE, the thermal transfer ribbon 1 includes a substrate 10, a dye layer 20, a transferable protective layer 30, and a heat-resistant lubricating layer 40. The dye layer 20 and the transferable protective layer 30 are provided on a first surface 10*a* of the substrate 10. The heat-resistant lubricating layer 40 is provided on a second surface 10*b* of the substrate 10 opposite to the first surface 10*a*. A plurality of sets of the dye layer 20 and the transferable protective layer 30 are repeatedly formed in the longitudinal direction of the thermal transfer ribbon 1.

Various plastic films can be used as the substrate 10. Although the material of the plastic film is not particularly limited, preferable in terms of high mechanical strength and smooth surface are polyester, polyethylene naphthalate, polystyrene, polysulfone, polyimide, polycarbonate, polypropylene, and the like. Among these, polyethylene terephthalate (PET) is preferable because it is relatively inexpensive and can form a thin film having high strength.

The thickness of the substrate 10 is not particularly limited, but is about 1 to 50 μm, for example.

The dye layer 20 of the present embodiment has three color layers, i.e., a yellow dye layer 21, a magenta dye layer 22, and a cyan dye layer 23. The number of color layers and the order of arrangement are not limited to the current aspect of the present embodiment, and can be set appropriately.

The base resin used in the dye layer 20 is preferably a polyvinyl butyral resin, which has a good balance of heat resistance, toughness, and the dyeing performance of the dye.

The polyvinyl butyral resin may contain a crosslinked structure. For example, a urethane crosslinked structure can be formed by incorporating a polyol component (hydroxyl group) into a polyvinyl butyral resin, and adding an isocyanate crosslinking agent for reaction.

The isocyanate crosslinking agent may be composed of a compound having at least one or more isocyanate groups per molecule. Examples include tolylene diisocyanate (TDI)-based crosslinking agents, hexamethylene diisocyanate (HDI)-based crosslinking agents, methylene diphenyl diisocyanate (MDI)-based crosslinking agents, xylylene diisocyanate (XDI)-based crosslinking agents, and the like.

As the dye used in the dye layer 20, general sublimation dyes used in thermal transfer ribbons can be used. Examples include diarylmethane-based dyes, triarylmethane-based dyes, thiazole-based dyes, methine-based dyes, azomethine-based dyes, xanthene-based dyes, oxazine-based dyes, thiazine-based dyes, azine-based dyes, acridine-based dyes, azo-based dyes, spiropyran-based dyes, indolinospiropyran-based dyes, fluoran-based dyes, rhodamine lactam-based dyes, anthraquinone-based dyes, and the like.

More specifically, examples of the yellow dye used in the yellow dye layer 21 include C.I. Solvent Yellow 14, 16, 29, 30, 33, 56, 93, etc., and C.I. Disperse Yellow 7, 33, 60, 141, 201, 231, etc. Examples of the magenta dye used in the magenta dye layer 22 include C.I. Solvent Red 18, 19, 27, 143, 182, etc., C.I. Disperse Red 60, 73, 135, 167, etc., and C.I. Disperse Violet 13, 26, 31, 56, etc. Examples of the cyan dye used in the cyan dye layer 23 include C.I. Solvent Blue 11, 36, 63, 105, etc., and C.I. Disperse Blue 24, 72, 154, 354, etc.

Each layer of the dye layer 20 may contain a silicone-based release agent. Examples of the silicone-based release agent include amino-modified silicone oil, epoxy-modified silicone oil, and the like.

The method for forming the dye layer 20 is not particularly limited. For example, first, each component described above is added to a solvent to prepare a dye layer-forming ink. The dye layer 20 can be formed on the substrate 10 by applying the dye layer-forming ink to the substrate 10 by gravure coating or the like, followed by drying.

Examples of solvents include methyl ethyl ketone, toluene, cyclohexanone, butyl cellosolve, and the like.

The thickness of each layer of the dye layer 20 is not particularly limited. For example, the thickness of each layer is about 0.5 to 2.0 μm, and may be set as appropriate in consideration of the appearance of the printed object etc.

The transferable protective layer 30 is a layer of a substantially transparent resin, and has a first layer 31 provided on the substrate 10, and a second layer 32 formed on the first layer 31.

The first layer 31 comprises, as main components, the following three resins, X, Y, and Z.

Resin X: an acrylic resin containing methyl methacrylate

Resin Y: an acrylic resin containing a styrene resin

Resin Z: a polyester resin

In the following description, the resin X, the resin Y, and the resin Z may be referred to simply as X, Y, and Z, respectively.

The mass ratio of X and Yin the first layer 31 is in the range of 1:9 to 9:1. When the resin X and the resin Y are mixed so that the mass ratio thereof is in the range of 1:9 to 9:1, the transfer performance of the transferable protective layer 30 is improved, and it is possible to form a protective layer that appropriately covers a print object layer formed on an image-receiving sheet by the dye layer 20. Methyl methacrylate has excellent plasticizer resistance, and styrene is a high-refractive index material; thus, reflection at the interface between the print object layer and the protective layer is high, and a print object with high gloss can be obtained. Further, the styrene resin has high affinity with a vinyl chloride resin, which is used as an image-receiving layer; in other words, the styrene resin has a similar solubility parameter, thereby improving the overprint transfer performance of the transferable protective layer 30.

When the resin Z is contained in the range of 1% to 3% with respect to the total mass of X and Y, the cold adhesion performance between the transferable protective layer 30 and the substrate 10 is improved. As a result, burrs and chips of the protective layer formed on the image-receiving sheet are preferably suppressed. When the cold adhesion performance is improved, the transferable protective layer is not peeled from the substrate during ribbon feeding operation that is performed during an initialization inside the printer, and transfer can be achieved without loss of the transferable protective layer from the substrate by the time of thermal transfer. As a result, burrs and chips can be suppressed.

The resin Z is preferably an amorphous polyester.

In the first layer 31, the weight average molecular weight Mw of the resin X is 120000 or more. Although it will be shown in the examples, the inventor has found that among the resins X, those having a weight average molecular weight of 120000 or more have an excellent effect of suppressing burrs and chips.

Examples of the resin X, which serves as the material of the first layer 31, include Dianal (registered trademark) series BR-88, BR-85, BR-84, BR-82, etc., produced by Mitsubishi Chemical Co., Ltd. Of these, BR-88, BR-85, BR-84, etc., are particularly preferable.

Examples of the resin Y include BR-52, BR-50, etc., of the Dianal series mentioned above.

Examples of the resin Z include Vylon (registered trademark) series 103, 200, 220, 226, 237, and 240, produced by Toyobo Co., Ltd.

The first layer 31 may contain various additives within the range that does not impair its function. Examples of additives include antistatic agents, charge control agents, ultraviolet absorbers, light stabilizers, antioxidants, fluorescent whitening agents, fillers, and the like.

The thickness of the first layer 31 can be set appropriately, and may be, for example, about 0.3 to 3 μm.

The second layer 32 is a layer that is brought into contact with and bonded to an image-receiving sheet and a print object layer formed on the image-receiving sheet.

As a material for the second layer 32, a resin that melts with heat can be used. Examples thereof include styrene resins, such as polystyrene and poly α-methyl styrene; acrylic resins, such as polymethyl methacrylate and polyethyl acrylate; vinyl resins, such as polyvinyl chloride, polyvinyl acetate, vinyl chloride-vinyl acetate copolymer, polyvinyl butyral, and polyvinyl acetal; synthetic resins, such as polyester resin, polyamide resin, epoxy resin, polyurethane resin, petroleum resin, ionomer, ethylene-acrylic acid copolymer, and ethylene-acrylic acid ester copolymer; cellulose derivatives, such as nitrocellulose, ethyl cellulose, and cellulose acetate propionate; natural resins and derivatives of synthetic rubber, such as rosin, rosin-modified maleic acid resin, ester gum, polyisobutylene rubber, butyl rubber, styrene-butadiene rubber, butadiene-acrylonitrile rubber, and polychlorinated olefin; waxes, such as carnauba wax and paraffin wax; and the like.

The second layer 32 may contain various functional additives, such as ultraviolet absorbers, light stabilizers, antioxidants, catalyst promoters, colorants, gloss modifiers, and fluorescent whitening agents.

The thickness of the second layer 32 can be set appropriately, and may be, for example, about 0.5 to 3.0 μm.

The heat-resistant lubricating layer 40 suppresses thermal adhesion between the thermal head of the printer and the thermal transfer ribbon 1. The heat-resistant lubricating layer 40 contains a binder, a lubricant, an abrasive, and the like.

Usable examples of the binder include reaction products of hydroxyl group-containing thermoplastic resins and isocyanates. Examples of hydroxyl group-containing thermoplastic resins include polyvinyl butyral, polyvinyl acetal, polyester polyol, acrylic polyol, polyether polyol, urethane polyol, and the like. Among these, an acrylic polyol is preferable, and one with a high molecular weight is particularly preferable. Polyisocyanates can be used as the isocyanates.

As the lubricant, for example, a phosphate ester can be used. The phosphate ester may have a structure in which, for example, one or two of three phosphoric acid groups per phosphoric acid molecule are esterified. Preferable examples of the phosphate ester include monoesters or diesters of alkylene oxide adducts of saturated alcohols (e.g., stearyl alcohol and lauryl alcohol) or unsaturated alcohols (e.g., oleyl alcohol) with phosphoric acid. The alkylene oxide is preferably ethylene oxide, and the addition number is preferably 1 to 20, and more preferably 1 to 8.

The abrasive has a role of removing print residues generated from the heat-resistant lubricating layer 40 in contact with the thermal head of the printer, or other layers of the thermal transfer ribbon 1. As the abrasive, for example, magnesium oxide can be used. The magnesium oxide used can be produced by a known method. Examples of known production methods include a method of baking and hydrolyzing magnesium carbonate, nitrate, hydroxide, etc.; a method of vapor phase oxidation of magnesium; and the like.

In addition to magnesium oxide, usable examples of abrasives include oxides, such as silica; clay minerals, such as talc and kaolin; carbonates, such as calcium carbonate and magnesium carbonate; hydroxides, such as aluminum hydroxide and magnesium hydroxide; sulfates, such as calcium sulfate; inorganic fine particles, such as graphite, glass, and boron nitride; organic resin fine particles, such as acrylic resin, fluororesin, silicone resin, phenol resin, acetal resin, polystyrene resin, and nylon resin; crosslinked resin fine particles obtained by reacting these with a crosslinking agent; and the like.

The method for forming the heat-resistant lubricating layer 40 is not particularly limited. For example, a mixture containing the above-mentioned components is prepared, applied to one surface of the substrate 10, and then dried.

The thickness of the heat-resistant lubricating layer 40 is not particularly limited and is 0.5 to 1.5 μm, for example.

The operation of the thermal transfer ribbon 1 configured as described above when used will be described.

The thermal transfer ribbon 1 is attached to a predetermined thermal transfer printer. The thermal transfer ribbon 1 is arranged in the thermal transfer printer so that the dye layer 20 side faces the image-receiving sheet. In this state, when the thermal head heats the thermal transfer ribbon 1 from the heat-resistant lubricating layer 40 side, each dye layer of the dye layer 20 is sublimed and transferred to the image-receiving sheet. In the present embodiment, the yellow dye layer 21, the magenta dye layer 22, and the cyan dye layer 23 are sequentially sublimed and transferred to the same area on the image-receiving sheet in a pattern according to the color of the print object, and finally a multicolored print object layer is formed on the image-receiving sheet.

Then, the transferable protective layer 30 is heated and transferred to the image-receiving sheet so as to cover the print object layer. Of the transferable protective layer 30, the first layer 31, which comes into contact with the substrate 10, includes X or Z mentioned above as a main component, and is configured to satisfy the above-mentioned conditions. Accordingly, the first layer 31 is easily peeled from the substrate 10 when softened upon heating, and does not cause stretching or tearing. As a result, it is possible to appropriately protect the print object layer by forming a protective layer, which corresponds to the shape of the print object layer and does not have burrs or chips, on the print object layer.

The thermal transfer ribbon of the present invention will be further described using examples and comparative examples. The present invention is not limited at all by the contents of the examples and comparative examples.

Unless otherwise specified, the term "part" in the description refers to parts by mass.

First, various inks of the formations shown below were prepared.

The ink for forming each layer was prepared by weighing materials other than methyl ethyl ketone and toluene, mixing them, then adding methyl ethyl ketone and toluene thereto, and propeller-stirring them while warming at 50° C. to dissolve the other materials in a solvent.

<Heat-Resistant Lubricating Layer-Forming Ink>

| | |
|---|---|
| Polyvinyl acetal resin | 25.2 parts |
| Isocyanate curing agent | 1.1 parts |
| Talc | 1.0 part |
| Methyl ethyl ketone | 36.4 parts |
| Toluene | 36.3 parts |

<Yellow Dye Layer-Forming Ink>

| | |
|---|---|
| C.I. Solvent Yellow 93 | 7.5 parts |
| C.I. Solvent Yellow 16 | 2.5 parts |
| Polyvinyl acetal resin | 8.5 parts |
| Silicone-modified resin | 0.2 parts |
| 2,6-Tolylene diisocyanate | 1.5 parts |
| Methyl ethyl ketone | 53.2 parts |
| Toluene | 26.6 parts |

<Magenta Dye Layer-Forming Ink>

| | |
|---|---|
| C.I. Disperse Red 60 | 5.0 parts |
| C.I. Disperse Violet 26 | 5.0 parts |
| Polyvinyl acetal resin | 8.5 parts |
| Silicone-modified resin | 0.2 parts |
| 2,6-Tolylene diisocyanate | 1.5 parts |
| Methyl ethyl ketone | 53.2 parts |
| Toluene | 26.6 parts |

<Cyan Dye Layer-Forming Ink>

| | |
|---|---|
| C.I. Solvent Blue 63 | 5.0 parts |
| C.I. Solvent Blue 36 | 5.0 parts |

-continued

| | |
|---|---|
| Polyvinyl acetal resin | 8.5 parts |
| Silicone-modified resin | 0.2 parts |
| 2,6-Tolylene diisocyanate | 1.5 parts |
| Methyl ethyl ketone | 53.2 parts |
| Toluene | 26.6 parts |

<First Layer-Forming Ink A>

| | |
|---|---|
| Dianal BR-85 | 1.0 part |
| Dianal BR-50 | 9.0 parts |
| Vylon 220 | 0.1 parts |
| Methyl ethyl ketone | 44.9 parts |
| Toluene | 45.0 parts |

<First Layer-Forming Ink B>

| | |
|---|---|
| BR-85 | 5.0 parts |
| BR-50 | 5.0 parts |
| Vylon 220 | 0.1 parts |
| Methyl ethyl ketone | 44.9 parts |
| Toluene | 45.0 parts |

<First Layer-Forming Ink C>

| | |
|---|---|
| BR-85 | 9.0 parts |
| BR-50 | 1.0 part |
| Vylon 220 | 0.1 parts |
| Methyl ethyl ketone | 44.9 parts |
| Toluene | 45.0 parts |

<First Layer-Forming Ink D>

| | |
|---|---|
| BR-84 | 5.0 parts |
| BR-50 | 5.0 parts |
| Vylon 220 | 0.1 parts |
| Methyl ethyl ketone | 44.9 parts |
| Toluene | 45.0 parts |

<First Layer-Forming Ink E>

| | |
|---|---|
| BR-85 | 5.0 parts |
| BR-50 | 5.0 parts |
| Vylon 220 | 0.3 parts |
| Methyl ethyl ketone | 44.7 parts |
| Toluene | 45.0 parts |

<First Layer-Forming Ink F>

| | |
|---|---|
| BR-85 | 5.0 parts |
| BR-50 | 5.0 parts |
| Vylon 220 | 0.5 parts |
| Methyl ethyl ketone | 44.5 parts |
| Toluene | 45.0 parts |

<First Layer-Forming Ink G>

| | |
|---|---|
| BR-85 | 5.0 parts |
| BR-50 | 5.0 parts |
| Vylon 220 | 0.09 parts |
| Methyl ethyl ketone | 44.91 parts |
| Toluene | 45.0 parts |

<First Layer-Forming Ink H>

| | |
|---|---|
| BR-85 | 0.9 parts |
| BR-50 | 9.1 parts |
| Methyl ethyl ketone | 45.0 parts |
| Toluene | 45.0 parts |

<First Layer-Forming Ink I>

| | |
|---|---|
| BR-85 | 9.1 parts |
| BR-50 | 0.9 parts |
| Methyl ethyl ketone | 45.0 parts |
| Toluene | 45.0 parts |

<First Layer-Forming Ink J>

| | |
|---|---|
| BR-83 | 5.0 parts |
| BR-50 | 5.0 parts |
| Methyl ethyl ketone | 45.0 parts |
| Toluene | 45.0 parts |

<First Layer-Forming Ink K>

| | |
|---|---|
| BR-85 | 10.0 parts |
| Methyl ethyl ketone | 45.0 parts |
| Toluene | 45.0 parts |

<First Layer-Forming Ink L>

| | |
|---|---|
| BR-84 | 10.0 parts |
| Methyl ethyl ketone | 45.0 parts |
| Toluene | 45.0 parts |

<First Layer-Forming Ink M>

| | |
|---|---|
| BR-83 | 10.0 parts |
| Methyl ethyl ketone | 45.0 parts |
| Toluene | 45.0 parts |

<First Layer-Forming Ink N>

| | |
|---|---|
| BR-50 | 10.0 parts |
| Methyl ethyl ketone | 45.0 parts |
| Toluene | 45.0 parts |

<First Layer-Forming Ink O>

| | |
|---|---|
| Dianal BR-113 (butyl methacrylate) | 10.0 parts |
| Methyl ethyl ketone | 45.0 parts |
| Toluene | 45.0 parts |

<First Layer-Forming Ink P>

| | |
|---|---|
| MB-2478 (produced by Mitsubishi Chemical Corporation) | 10.0 parts |
| Methyl ethyl ketone | 45.0 parts |
| Toluene | 45.0 parts |

<Second Layer-Forming Ink>

| | |
|---|---|
| MB-2389 (methyl polymethacrylate, produced by Mitsubishi Chemical Corporation) | 10.0 parts |
| 2-(Hydroxy-5-t-butylphenyl)-2H-benzotriazole | 0.5 parts |
| Methyl ethyl ketone | 89.5 parts |

<Ink-Receiving Layer-Forming Ink>

| | |
|---|---|
| Vinyl chloride-vinyl acetate-vinyl alcohol copolymer | 19.5 parts |
| Amino-modified silicone oil | 0.5 parts |
| Methyl ethyl ketone | 40.0 parts |
| Toluene | 40.0 parts |

A substrate with a heat-resistant lubricating layer common to the thermal transfer ribbon of each example was produced in the following procedure.

<Production of Substrate with Heat-Resistant Lubricating Layer>

The heat-resistant lubricating layer-forming ink described above was applied to one surface of a substrate (a polyethylene terephthalate film: 4.5 μm in thickness) by a gravure coating method, and dried to form a heat-resistant lubricating layer having a dried thickness of 0.9 μm. Subsequently, aging was performed at 50° C. for 6 days, thereby obtaining a substrate with a heat-resistant lubricating layer.

An image-receiving sheet for evaluating the performance of each example was produced by the following procedure.

<Production of Image-Receiving Sheet>

The ink-receiving layer-forming ink described above was applied to one surface of a substrate sheet (a foaming polyester film: 188 μm in thickness) by a gravure coating method, and dried to form an ink-receiving layer having a dried thickness of 5.0 μm, thereby obtaining an image-receiving sheet.

Example 1

In the substrate with the heat-resistant lubricating layer described above, the surface not provided with the heat-resistant lubricating layer was subjected to corona treatment. Next, using the yellow dye layer-forming ink, magenta dye layer-forming ink, cyan dye layer-forming ink, and first layer-forming ink A, a yellow dye layer, a magenta dye layer, a cyan dye layer, and a first layer were sequentially formed on the substrate by a gravure coating method. The film thickness of each dye layer after drying was 0.7 μm, and the film thickness of the first layer after drying was 0.5 μm.

Finally, a second layer was formed on the first layer using the second layer-forming ink by a gravure coating method. The film thickness of the second layer after drying was 0.5 μm.

A thermal transfer ribbon of Example 1 was produced in the above manner.

Example 2

A thermal transfer ribbon of Example 2 was produced in the same manner as in Example 1, except that the first layer-forming ink B was used in place of the first layer-forming ink A.

Example 3

A thermal transfer ribbon of Example 3 was produced in the same manner as in Example 1, except that the first layer-forming ink C was used in place of the first layer-forming ink A.

Example 4

A thermal transfer ribbon of Example 4 was produced in the same manner as in Example 1, except that the first layer-forming ink D was used in place of the first layer-forming ink A.

Example 5

A thermal transfer ribbon of Example 5 was produced in the same manner as in Example 1, except that the first layer-forming ink E was used in place of the first layer-forming ink A.

Comparative Example 1

A thermal transfer ribbon of Comparative Example 1 was produced in the same manner as in Example 1, except that the first layer-forming ink F was used in place of the first layer-forming ink A.

Comparative Example 2

A thermal transfer ribbon of Comparative Example 2 was produced in the same manner as in Example 1, except that the first layer-forming ink G was used in place of the first layer-forming ink A.

Comparative Example 3

A thermal transfer ribbon of Comparative Example 3 was produced in the same manner as in Example 1, except that the first layer-forming ink H was used in place of the first layer-forming ink A.

Comparative Example 4

A thermal transfer ribbon of Comparative Example 4 was produced in the same manner as in Example 1, except that the first layer-forming ink I was used in place of the first layer-forming ink A.

Comparative Example 5

A thermal transfer ribbon of Comparative Example 5 was produced in the same manner as in Example 1, except that the first layer-forming ink J was used in place of the first layer-forming ink A.

Comparative Example 6

A thermal transfer ribbon of Comparative Example 6 was produced in the same manner as in Example 1, except that the first layer-forming ink K was used in place of the first layer-forming ink A.

Comparative Example 7

A thermal transfer ribbon of Comparative Example 7 was produced in the same manner as in Example 1, except that the first layer-forming ink L was used in place of the first layer-forming ink A.

Comparative Example 8

A thermal transfer ribbon of Comparative Example 8 was produced in the same manner as in Example 1, except that the first layer-forming ink M was used in place of the first layer-forming ink A.

Comparative Example 9

A thermal transfer ribbon of Comparative Example 9 was produced in the same manner as in Example 1, except that the first layer-forming ink N was used in place of the first layer-forming ink A.

Comparative Example 10

A thermal transfer ribbon of Comparative Example 10 was produced in the same manner as in Example 1, except that the first layer-forming ink O was used in place of the first layer-forming ink A.

Comparative Example 11

A thermal transfer ribbon of Comparative Example 11 was produced in the same manner as in Example 1, except that the first layer-forming ink P was used in place of the first layer-forming ink A.

<Production of Print Object for Evaluation>

The thermal transfer ribbon according to each example and each comparative example was set in a Thermal Photo Printer D-70 (produced by Mitsubishi Electric Corporation), and a predetermined image was printed on the ink-receiving layer of the image-receiving sheet, thereby obtaining a print object for evaluation according to each example.

The following evaluations were performed on the print object for evaluation of each example and the operation during production of the print object.

<Protective Layer Transfer Performance Evaluation>

The transferability was evaluated by performing printing with the take-up torque of the take-up side of the Thermal Photo Printer set to low. When printing succeeded without causing jamming or ribbon breakage during transfer, this case was evaluated as "Good," and when jamming or ribbon breakage occurred, this case was evaluated as "Poor."

<Glossiness>

As a print object for evaluation, the entire surface was printed with a white color (no dye layer, only protective layer). The surface glossiness of the print object for evaluation was measured using NOVO-GLOSS (produced by Rhopoint Instruments). When the glossiness at an angle of 60° was 80 or more, this case was evaluated as "Good," and when the glossiness at an angle of 60° was less than 80, this case was evaluated as "Poor."

<Burrs and Chips of Print Object>

For each example, a print object for evaluation was prepared by printing the entire surface with a black color. Each print object for evaluation was visually observed. When there were burrs and chips, this case was evaluated as "Poor," and when there were no burrs or chips, this case was evaluated as "Good."

<Plasticizer Resistance>

In the print object for evaluation with the entire surface printed with black color of each example, the print part and a Tombow Mono Eraser were brought into contact with each other with a load of 200 g, and stored in an environment at 50° C. for 12 hours. The reflection density of the print part before and after storage was measured using an X-Rite reflection densitometer. When the reflection density after storage was 80% or more of that before storage, this case was evaluated as "Good," and when the reflection density after storage was less than 80% of that before storage, this case was evaluated as "Poor."

Table 1 shows the results.

TABLE 1

| | | Average molecular weight | Example 1 | 2 | 3 | 4 | 5 | Comparative Example 1 | 2 | 3 | 4 | 5 | 6 | 7 | 8 | 9 | 10 | 11 |
|---|---|---|---|---|---|---|---|---|---|---|---|---|---|---|---|---|---|---|
| Material (parts by mass) | Resin X BR-85 | 280000 | 1 | 5 | 9 | | 5 | 5 | 5 | 0.9 | 9.1 | | 10 | | | | | |
| | Resin X BR-84 | 120000 | | | | 5 | | | | | | | | 10 | | | | |
| | Resin X BR-83 | 40000 | | | | | | | | | | 5 | | | 10 | | | |
| | Resin Y BR-50 | | 9 | 5 | 1 | 5 | 5 | 5 | 5 | 9.1 | 0.9 | 5 | | | | 10 | | |
| | n-BMA | | | | | | | | | | | | | | | | 10 | |
| | BR113 | | | | | | | | | | | | | | | | | |
| | Ester MB2478 | | | | | | | | | | | | | | | | | 10 |
| | Resin Z | | 0.1 | 0.1 | 0.1 | 0.1 | 0.3 | 0.5 | 0.09 | | | | | | | | | |
| | Vylon 220 | | | | | | | | | | | | | | | | | |
| Evaluation results | Protective layer transfer performance | | Good | Good | Good | Good | Good | Poor | Good | Good | Poor | Good | Poor | Poor | Poor | Good | Good | Good |
| | Glossiness | | Good | Good | Good | Good | Good | Good | Good | Good | Poor | Good | Poor | Poor | Poor | Good | Poor | Poor |
| | Burrs, chips | | Good | Good | Good | Good | Good | Good | Poor | Poor | Poor | Poor | Poor | Poor | Poor | Poor | Poor | Poor |
| | Plasticizer resistance | | Good | Good | Good | Good | Good | Good | Good | Poor | Good | Poor | Good | Good | Poor | Poor | Poor | Poor |

As shown in Table 1, in the thermal transfer ribbon of each example, the evaluation of all items, i.e., protective layer transfer performance, glossiness, burrs and chips, and plasticizer resistance, was excellent.

On the other hand, in the comparative examples, which did not contain any of the resins X to Z, or which contained all of the resins X to Z but did not satisfy the predetermined conditions, the quality of the print objects was insufficient, mainly in terms of "burrs and chips."

The thermal transfer ribbon of the present invention can be used for sublimation transfer printers. When the thermal transfer protective layer is thermally transferred after image formation, the thermal transfer ribbon of the present invention can suitably suppress the occurrence of burrs, chips, etc. The protective layer of the print object obtained with the thermal transfer ribbon of the present invention has excellent durability, such as plasticizer resistance, and high glossiness. Therefore, the thermal transfer ribbon of the present invention can be expected to be applied to a wide range of fields that require various color outputs, including cards such as identification cards, for which durability is required.

INDUSTRIAL APPLICABILITY

The thermal transfer ribbon of the present invention can be used for sublimation transfer printers.

REFERENCE SIGNS LIST

1 . . . Thermal transfer ribbon; 10 . . . Substrate; 20 . . . Dye layer; 30 . . . Transferable protective layer; 31 . . . First layer; 32 . . . Second layer.

What is claimed is:

1. A thermal transfer ribbon, comprising:

a dye layer and a transferable protective layer repeatedly formed on one surface of a substrate, the transferable protective layer having a first layer formed on the substrate, and a second layer formed on the first layer, the first layer comprising:

an acrylic resin (X) containing methyl methacrylate, an acrylic resin (Y) containing a styrene resin, and a polyester resin (Z), X having a weight average molecular weight of 120000 or more, the mass ratio of X and Y being in a range of 1:9 to 9:1, and the mass of Z being 3% of a total mass of X and Y.

2. The thermal transfer ribbon of claim 1, wherein Z is an amorphous polyester.

* * * * *